US005170844A

United States Patent [19]

George et al.

[11] Patent Number: 5,170,844

[45] Date of Patent: Dec. 15, 1992

[54] PRESSURE RESPONSIVE BELOW-PACKER VALVE APPARATUS

[75] Inventors: Flint R. George, Katy; Kevin R. George, Columbus; Joe Henke, Katy, all of Tex.

[73] Assignee: Halliburton Logging Services, Inc., Houston, Tex.

[21] Appl. No.: 757,615

[22] Filed: Sep. 11, 1991

[51] Int. Cl.[5] ..... E21B 33/00; E21B 43/00

[52] U.S. Cl. ..... 166/319; 166/317; 166/297

[58] Field of Search ..... 166/297, 299, 373, 317–321, 166/386

[56] References Cited

U.S. PATENT DOCUMENTS 4,434,854 3/1984 Vann et al. ..... 166/319 X
4,576,233 3/1986 George ..... 166/297
4,846,272 7/1989 Leggett ..... 166/317 X
5,109,925 5/1992 Stepp et al. ..... 166/317 X

*Primary Examiner*—Thuy M. Bui
*Attorney, Agent, or Firm*—Arnold, White & Durkee

[57] ABSTRACT

A pressure responsive below packer valve apparatus which allows operation of a below packer valve through application of pressure to the wellbore annulus above the packer. The valve apparatus includes a cross-over located in a tool string above the packer which communicates upper annulus pressure to a conduit inside the tool string. This conduit communicates annulus pressure to a valve mechanism below the packer. A selectively releasable mechanism such as a rupture disk communicates pressure to the valve mechanism once a threshold pressure is reached, thereby facilitating operation of the valve mechanism through application of annulus pressure.

11 Claims, 2 Drawing Sheets

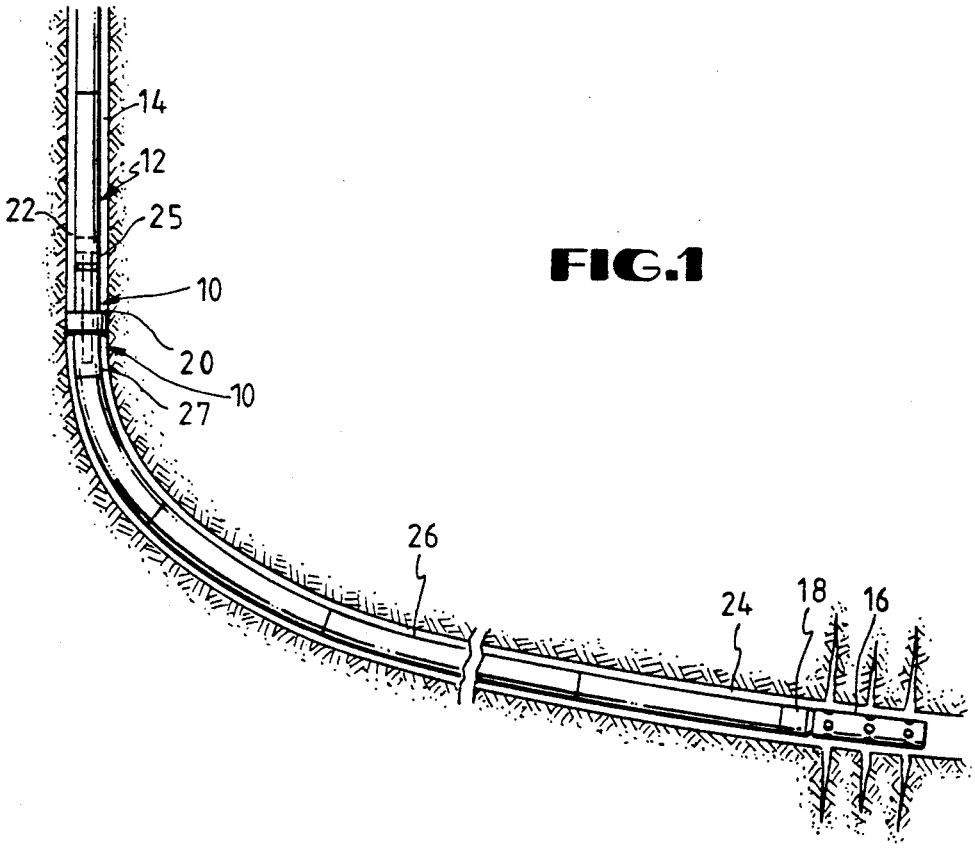
FIG.1
FIG.3
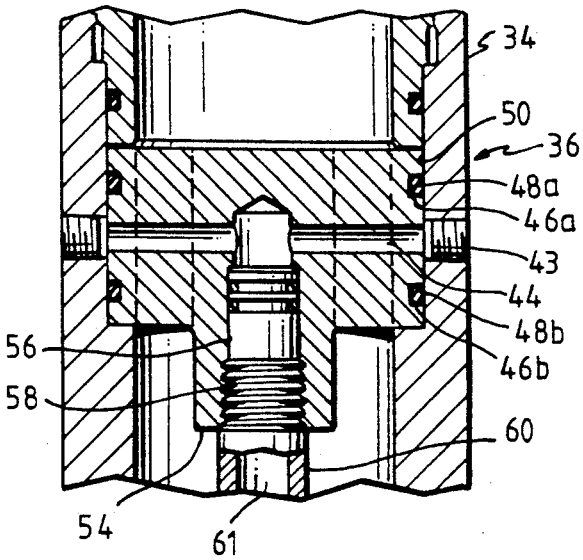
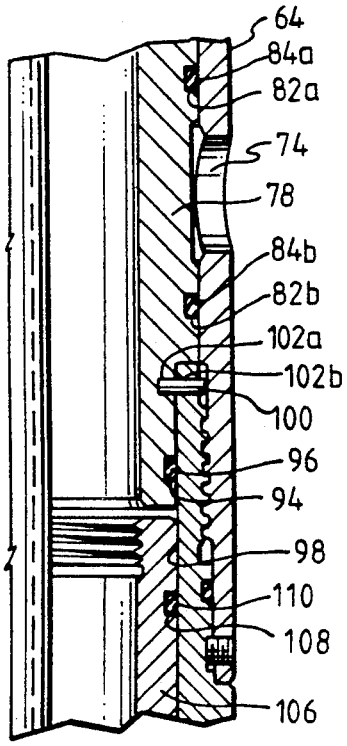
FIG.4

PRESSURE RESPONSIVE BELOW-PACKER VALVE APPARATUS

BACKGROUND OF THE INVENTION

The present invention relates generally to pressure responsive valves for use in subsurface operations, and more particularly relates to pressure actuated valves particularly well suited for use below a packer in a subsurface well.

Subsurface valves are commonly utilized in the oil and gas industry to establish a flow path between the interior of a conduit and the exterior of a conduit. In particular, such valves are commonly utilized to establish a flow path between the interior of a tubing string and the well annulus. Where such valves are placed in a tool string below the packer, they are typically referred to as "vents." Conventional vents are either mechanically actuated or pressure actuated. Where the vents are mechanically actuated, movement of the valve member in the vent is accomplished either by mechanical movement of an actuation member, or by the mechanical breaking of pressure kobes, to allow existing hydraulic pressures to operate the valve member. An example of this latter type of valve is disclosed in U.S. Pat. No. 4,576,233, issued to Flint R. George, and assigned to the assignee of the present invention. Where conventional vents are pressure actuated, they are typically responsive either to pressure inside the tubing string, or to pressure supplied to the vent through a dedicated conduit, such as a control line, external to the tubing string.

The use of conventional tubing pressure-actuated vents is not always desirable in perforating operations. In many perforating operations, it will be desired to perforate the well with an underbalance (i.e., with a pressure in the tubing string which is less than the anticipated formation pressure). In many such operations, after the tubing pressure has been raised to actuate the vent, the pressure must be reduced to a lower desired level to establish the desired under-balance. Where this pressure in the tubing string is also to be utilized to actuate the perforating gun, such an operation typically requires that the pressure be established through use of nitrogen, which requires utilizing auxiliary nitrogen units on-site. Such operations typically do not provide an opportunity for use of other conventional methods of reducing pressure to the well, such as swabbing the well, even if a time delay firing head were utilized.

Where pressure from a control line is utilized to actuate a vent, the provisions for the control line running along the exterior of the tubing make assembly of the string undesirably complex. The assembly of such a structure becomes especially time consuming, and therefore costly, where a long interval is to be established between the packer and the vent, which will typically be located generally proximate the perforating gun firing head. Such long intervals are common in highly deviated, or in horizontal wells.

Accordingly, the present invention provides a new method and apparatus for actuating a vent through use of pressure in the well annulus above the packer whereby the vent may be placed at any desired location relative to the packer without significantly complicating the assembly of the tool string.

SUMMARY OF THE INVENTION

The present invention includes a valve apparatus particularly useful in a tool string which includes a packer. The valve apparatus will include a crossover assembly, placed in the tool string above the packer, and configured to provide fluid communication between the fluid annulus above the packer and a first location, or passageway, within the tool string. The valve apparatus includes a conduit placed internal to the packer and remainder of the tool string, and coupled to the crossover assembly to provide fluid communication between the passageway (and therefore the upper wellbore annulus), to a second location below the packer. This second location may be merely a passageway, but in at least one preferred embodiment, will include the interior of the tool string below the packer.

The valve assembly will include a piston which is in selective fluid communication with the second location. The selective fluid communication will preferably be provided by a pressure responsive mechanism. This pressure responsive mechanism may be a hydraulically releasable valve, or similar apparatus. However, preferably, the pressure releasable mechanism will include a frangible member, such as a rupture disk, which will break at a predetermined pressure level.

BRIEF DESCRIPTION OF THE DRAWINGS

FIG. 1 depicts an exemplary portion of a tool string including a pressure actuated vent assembly in accordance with the present invention.

FIG. 3 depicts the crossover sub of the pressure actuated vent assembly of FIG. 2 in greater detail, illustrated partially in vertical section.

FIG. 4 depicts the sleeve valve retention mechanism of the pressure actuated vent assembly of FIG. 2 in greater detail, illustrated partially in vertical section.

DETAILED DESCRIPTION OF A PREFERRED EMBODIMENT

Figure 2A:
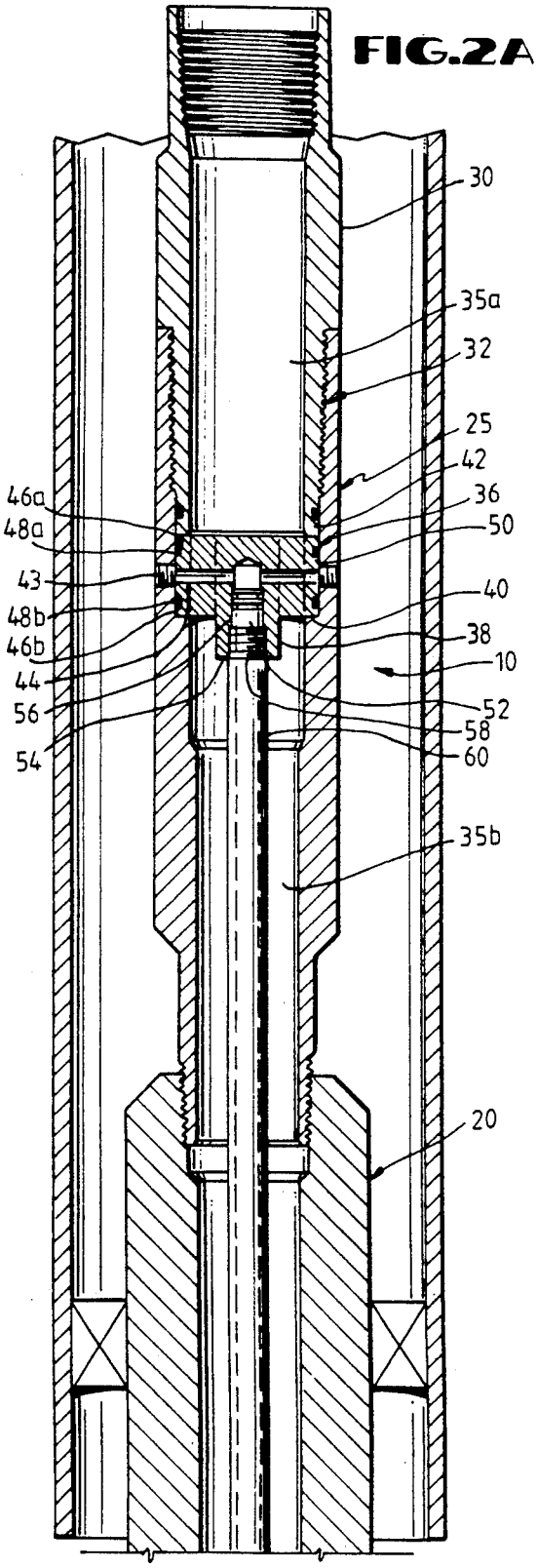
FIG. 2A–B depicts the pressure actuated vent assembly of FIG. 1 in greater detail, illustrated partially in vertical section.

Referring now to the drawings in more detail, and particularly to FIG. 1, therein is depicted a pressure actuated vent assembly 10, in accordance with the present invention, indicated generally at 10, installed as a portion of a tool string, indicated generally at 12, disposed within a wellbore 14. Pressure actuated vent assembly 10 includes two operatively connected components, an annulus pressure crossover assembly 25, and a vent valve assembly 27.

Wellbore 14 will typically be a cased wellbore in which casing has been installed through use of cement, in a manner well-known to the art. Tool string 12, as depicted, includes one or more perforating guns 16. Perforating gun 16 will be operably associated with a tubing pressure actuated firing head 18.

As depicted in FIG. 1, wellbore 14 is a highly deviated wellbore, to an extent commonly referred to as a "horizontal wellbore." Tool string 12 includes a packer 20 which is placed proximate the relatively "vertical" portion 22 of wellbore 14. This position simplifies placement and setting of packer 20 in a wellbore which is highly deviated as horizontal as depicted in the exemplary wellbore 14 of FIG. 1. Conversely, perforating gun 16 is located a substantial distance further down wellbore 14 in a generally "horizontal" section 24 of wellbore 14. Perforating gun 16 and firing head 18 will be coupled to packer 20 in tool string 12 by a span of tubing 26, in a conventional manner.

Figure 2B:
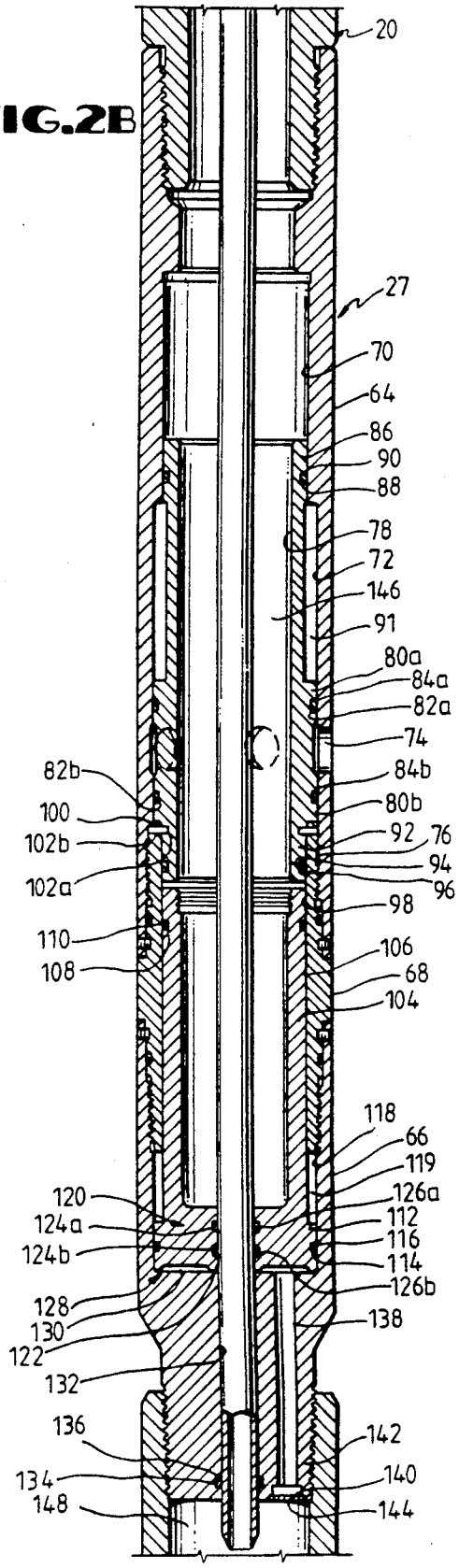

Referring now to FIGS. 2A–B, therein is depicted pressure actuated vent assembly 10, illustrated substantially in vertical section. As previously depicted and described, pressure actuated vent assembly 10 includes annulus pressure crossover assembly 25 placed in tool string 12 above packer 20. Annulus pressure crossover assembly 25 includes an upper sub 30 to facilitate attachment as a portion of tool string 12. Upper sub 30 is coupled through a conventional threaded coupling 32 to an upper housing 34. Upper housing 34 cooperates with upper sub 30 to define an open bore 35*a*, 35*b* and to house a vent crossover assembly, indicated generally at 36, therein. Vent crossover assembly 36 includes crossover block 38. Housing 34 includes an upwardly facing shoulder 40 which provides a lower seating surface for crossover block 38. Crossover block 38 is retained securely against shoulder 40 through contact with lower end 42 of upper sub 30. Crossover block 38 includes a transverse bore 44 extending therethrough, which transverse bore is in fluid communication with ports 43 in housing 34. Crossover block 38 also includes upper and lower circumferential grooves 46*a* and 46*b*, respectively, which are disposed on opposite sides of transverse bore 44. Each circumferential groove 46*a*, 46*b* houses an o-ring, 48*a* and 48*b*, respectively. O-rings 48*a* and 48*b* serve to sealingly engage interior surface 50 of upper housing 34 to isolate transverse bore 44 from the interior bore 35*a*, 35*b* of upper housing 34.

Crossover block 38 also includes a generally central longitudinal bore 52 which, at an upper extent, fully intersects transverse bore 44, and which at a lower extent extends to the lower surface 54 of crossover block 38. Central longitudinal bore 52 includes a seal bore 56, and a threaded surface 58. Sealbore 56 and threaded surface 58 facilitate communication of crossover block 38 with a central conduit 60, which extends downwardly through the tool string 12, as will be described further later herein. Crossover block 38 also includes a plurality of radially spaced longitudinal bores 54*a*, 54*b*. Although only two radially spaced longitudinal bores 54*a*, 54*b* are depicted, typically four or more generally equidistantly spaced bores would be desirable, as these bores 54*a*, 54*b* provide a flow path through the tubing string, and a maximal area open to fluid flow is typically desirable.

Upper housing 34 may be coupled directly to a packer assembly 20, or may be coupled to a length of tubing. Packer assembly 20 may be of any desired type, such as either a mechanically or hydraulically set packer. As depicted in FIG. 1, coupled beneath packer assembly 20 will be vent valve assembly 27 of pressure actuated vent assembly 10. A span of tubing 26 may then be coupled in tool string 12. Tubing 26 will extend to the desired placement of other equipment in tool string 12, such as firing head 18, as depicted in FIG. 1.

Vent valve assembly 27 includes an upper housing 64, a lower housing 66, and a housing coupling sub 68. Upper housing 64 includes a first bore 70 of a first diameter and a second bore 72 of a second, larger, diameter. Upper housing 64 also includes a plurality of radial apertures 74 proximate said second bore. Upper housing 64 is joined, through a threaded coupling 76 to housing coupling sub 68. Operatively associated with upper housing 64 is valve sleeve 78 which will selectively cover or uncover radial apertures 74. Valve sleeve 78 includes a pair of radially outwardly extending shoulders 80*a*, 80*b*. Each radially outwardly extending shoulder 80*a*, 80*b* includes a circumferential groove 82*a* and 82*b*, respectively, each of which houses an o-ring 84*a*, 84*b*. Radially outwardly extending shoulders 80*a*, 80*b* are sized to allow o-rings 84*a*, 84*b* to sealingly engage second interior bore 72 of upper housing 64.

Valve sleeve 78 also includes an upper radially outwardly extending flange 86. Upper radially outwardly extending flange 86 also includes a circumferential groove 88 housing an o-ring 90. Upper radially outwardly extending flange 86 is sized to allow o-ring 90 to sealingly engage first interior bore 70 of upper housing 64. When valve sleeve 78 is in a first, unactuated, position, o-rings 84*a*, 84*b* will be disposed on opposite sides of radial apertures 74 in upper housing 64, thereby isolating radial apertures 74 from the interior of vent valve assembly 27. Additionally, it will be apparent that o-rings 84*a* and 84*b* will cause valve sleeve 78 to be pressure balanced with respect to pressures within lower wellbore annulus 24 when valve sleeve 78 is in this first, unactuated, position. Valve sleeve 78 also includes a lower extension skirt 92. Lower extension skirt 92 also includes a circumferential groove 94 housing an o-ring 96. O-ring 96 sealingly engages an interior surface 98 of housing coupling sub 68. Valve sleeve 78 is retained in the first, unactuated, position by one or more shear pins 100 which engage complementary apertures 102*a*, 102*b* in valve sleeve 78 and housing coupling sub 68, respectively.

Vent valve assembly 27 also includes an actuation piston 104. Actuation piston 104 is a generally cylindrical member, preferably disposed generally coaxially with valve sleeve 78 within housing coupling sub 68 and lower housing 66. Actuation piston 104 includes a base portion 120 proximate its lower end, and includes generally cylindrical sidewalls extending generally vertically therefrom. Cylindrical sidewalls 106 of actuation piston 104 include, proximate their upper end, a circumferential groove 108 housing an o-ring 110. O-ring 110 sealingly engages interior surface 98 of housing coupling sub 68. Actuation piston 104 includes a radially outwardly extending flange 112 extending from base portion 120. Radially extending flange 112 includes a circumferential groove 114 housing an o-ring 116, which sealingly engages an interior surface of lower housing 66. Base portion 120 also includes a central bore 122. Base section 120 will also include a plurality of radially inwardly extending grooves 124*a*, 124*b* associated with central bore 122. Each groove 124*a*, 124*b* houses an o-ring 126*a*, 126*b*, respectively, which sealingly engage central conduit 60 coupled to crossover block 38. Lower surface 128 of base portion 120 includes an annular recess 130 intermediate its inner diameter and outer diameter.

Lower housing 66 includes a central bore 132 adapted to accommodate central conduit 60. Central bore 132 will also include a radially inwardly extending groove 134 housing an o-ring 136. O-ring 136 is adapted to sealingly engage central conduit 60 which extends through the tool string from upper crossover block 38 down through lower housing 66. Central conduit 60 will terminate a short distance, for example, 0.75–1.0 inches beyond the lower surface of lower housing 66. Lower housing 66 also includes a radially offset pressure bore 138. Pressure bore 138 includes an enlarged area 140 proximate the lower extent 142 of lower housing 66. Enlarged area 140 is adapted to receive and retain a burst disk 144. Burst disk 144 may be adapted to threadably engage enlarged area 140, or may be sealingly retained therein by a retention mechanism, such as a screw ring. Lower housing 66 may be coupled at its lower end to a tubing joint, such as a pup joint, or directly to the housing of the tubing pressure actuated firing head (element 18 in FIG. 1). Central conduit 60 includes a central longitudinal bore 61 adapted to provide fluid communication between central longitudinal bore 52 of crossover block 38 and the area within the tool string beneath lower housing 66 of vent valve assembly 27.

In operation, pressure actuated vent assembly 10 will be operated in conjunction with the remainder of the tool string as follows. The tool string 12 including the pressure actuated vent assembly 10 will be run into the wellbore 14 until perforating gun 16 is positioned adjacent the area to be perforated. At such time, packer assembly 20 will be set in the wellbore 14 to isolate an upper wellbore annulus (i.e., the annulus above the packer) from a lower wellbore annulus (i.e., annulus below the packer). When it is desired to open the vent valve assembly 27 by moving valve sleeve 78, pressure will be applied to the upper wellbore annulus. This pressure will be communicated through ports 43 in upper housing 34, through transverse bore 44 and longitudinal bore 52 in crossover block 38 to central bore 61 in central conduit 60. The pressure in the upper wellbore annulus, therefore, will be communicated through central conduit 60 to the interior of the tool string 148 beneath lower housing 66 of vent valve assembly 62. Once this pressure reaches a first threshold pressure, for example 2,000 psi, the rupture disk will rupture. Rupture of the rupture disk exposes actuation piston 104 to the pressure in the upper wellbore annulus. This pressure on actuation piston 104 will cause the piston to move upwardly against an air chamber 119 formed between o-ring seals 116 and 110. Upward movement of actuation piston will cause shearing of shear pins 100 and will move valve sleeve 78 upwardly to move o-ring **84*a* above at least a portion of aperture 74. The fluid pressure in lower wellbore annulus 24 will then move valve sleeve 78 upwardly against an air chamber 91 formed between o-ring seals 84*a* and 90. This upper movement of valve sleeve 78 will fully uncover radial aperture 74 allowing fluid communication between lower wellbore annulus 24 and the interior 146 of the tool string. The lower end 121 of coupling sub 68 will contact flange 112 on base portion 120 of actuation piston 104 and act as a stop to limit travel of actuation piston 104**.

The operator should be able, by carefully monitoring of the applied annular pressure, to determine the pressure integrity of the packer seal. Once the integrity of the seal is thus determined, the annulus pressure may be increased to a second threshold level determined as the predetermined actuation pressure of the firing device. Crossover assembly 36 and central conduit 60 enable such annulus pressure to be communicated to lower chamber 48 in tubing span 26, and thereby to a tubing pressure actuated firing head 18. Once this second threshold pressure is reached, the perforating gun will actuate, and fluid will be free to flow through radial port 74 into interior 146 of tubing string 12. Radially spaced longitudinal bores **54*a*, 54*b* in crossover block 38** further facilitate fluid communication of the produced fluid with the earth's surface.

Many modifications and variations may be made in the techniques and structures described and illustrated herein without departing from the spirit and scope of the present invention. For example, additional pressure operated devices, such as additional vents, etc. may be located between lower housing 66 of vent valve assembly 62 and firing head 18, so long as a flow path is provided between the interior of central conduit 60 and firing head 18. Additionally, other types of pressure responsive valve mechanisms than burst disk 144 may be utilized to be selectively responsible to a predetermined pressure differential to selectively facilitate communication with pressure bore 138. Accordingly, it should be readily understood that the embodiments described and illustrated herein are illustrative only, and are not to be considered as limitations upon the scope of the present invention.

What is claimed is:

1. A valve assembly for use in a tool string including a packer, comprising:

a crossover assembly placed in said tool string above said packer, said crossover assembly providing fluid communication between the annulus above said packer and a first location within said tool string;

a conduit located internal to said tool string, said conduit providing fluid communication between said first location and a second location below said packer in said tool string;

a valve assembly located in said tool string below said packer, said valve assembly comprising a piston in selective fluid communication with said second location;

a pressure responsive mechanism selectively operable in response to fluid pressure to establish said selective fluid communication between said second location and said piston of said valve assembly.

2. The valve assembly of claim 1, wherein said valve assembly further comprises:

a housing assembly, said housing assembly having at least one aperture therein;

a valve sleeve within said housing, said valve sleeve movable between first and second positions relative to said housing, said valve sleeve isolating said aperture in said housing when said valve sleeve is in a first position, and said valve sleeve opening said aperture to fluid flow when said valve sleeve is in said second position.

3. The valve assembly of claim 2 wherein said valve sleeve is movable between said first and second positions in response to movement of said piston of said valve assembly.

4. The valve assembly of claim 2 wherein said valve sleeve is longitudinally movable between said first and second positions.

5. The valve assembly of claim 1 wherein said pressure responsive mechanism comprises a rupture disk.

6. The valve assembly of claim 1 wherein said second location comprises a chamber formed in said tool string.

7. The valve assembly of claim 1 wherein said tool string further comprises a perforating gun and a pressure-actuated firing head, and wherein said pressure-actuating firing head is in fluid communication with said chamber.

8. A valve mechanism for use in a tool string including a packer, comprising:

a crossover assembly included in said tool string above said packer, said crossover assembly including a passageway in fluid communication with the exterior of said tool string above said packer;

a conduit inside said tool string, said conduit coupled to said crossover assembly to provide fluid communication between said passageway and a chamber in said tool string beneath said packer;

a valve assembly placed in said tool string below said packer, said valve assembly comprising, a housing having a radial aperture therein;

a valve sleeve movable between a first position and second position, said valve sleeve sealingly isolating said aperture from the interior of said valve assembly housing when said valve sleeve is in a first position, and allowing fluid communication from said aperture to the interior of said valve assembly housing when said valve sleeve is in a second location;

an actuation piston surface movable in response to a fluid pressure, said piston surface cooperatively arranged with said valve sleeve to selectively move said valve sleeve from said first position to said second position.

9. The valve assembly of claim 8, wherein said piston surface is contained on an actuation piston which is placed in said valve housing in generally coaxial relation to said valve sleeve.

10. The valve assembly of claim 8, wherein said pressure responsive mechanism comprises a frangible member breakable in response to hydraulic pressure.

11. The valve assembly of claim 8, wherein said conduit comprises a generally cylindrical tube extending from said crossover assembly, through said packer, to said second location.

* * * * *